US005197538A

United States Patent [19]

Nagasaka et al.

[11] Patent Number: 5,197,538

[45] Date of Patent: Mar. 30, 1993

[54] HEAT EXCHANGER APPARATUS HAVING FLUID COUPLED PRIMARY HEAT EXCHANGER UNIT AND AUXILIARY HEAT EXCHANGER UNIT

[75] Inventors: Yoshikiyo Nagasaka; Takashi Sugita; Tadaaki Ishikawa, all of Konan, Japan

[73] Assignee: Zexel Corporation, Tokyo, Japan

[21] Appl. No.: 870,425

[22] Filed: Apr. 17, 1992

[30] Foreign Application Priority Data

Apr. 22, 1991 [JP] Japan ..... 3-117959
Sep. 13, 1991 [JP] Japan ..... 3-234337

[51] Int. Cl.[5] ..... F28F 9/26
[52] U.S. Cl. ..... 165/144; 165/149
[58] Field of Search ..... 165/144, 149, 140, 176

[56] References Cited

U.S. PATENT DOCUMENTS 4,481,724 11/1984 Petrovic et al. ..... 34/168
4,651,816 3/1987 Struss et al. ..... 165/26
4,936,379 6/1990 Hoshino et al. ..... 165/150
5,046,554 9/1991 Iwasaki et al. ..... 165/140
5,086,835 2/1992 Shinmura ..... 165/144

FOREIGN PATENT DOCUMENTS 63-74989 5/1988 Japan .
1-147286 6/1989 Japan .
1-161106 11/1989 Japan .
2-13952 1/1990 Japan .
2-127957 10/1990 Japan .
3-71292 7/1991 Japan .
3-87065 9/1991 Japan .
3-104658 10/1991 Japan .
4-86483 3/1992 Japan .
4-86484 3/1992 Japan .
130117 7/1919 United Kingdom ..... 165/140

*Primary Examiner*—Allen J. Flanigan
*Attorney, Agent, or Firm*—Wenderoth, Lind & Ponack

[57] ABSTRACT

A sturdy heat exchanger, having a variable configuration, is constructed by separately building a primary heat exchanger and an auxiliary heat exchanger, connecting the primary heat exchanger and the auxiliary heat exchanger via brackets mounted on the header pipes of the primary heat exchanger and on the auxiliary heat exchanger, and fluid connecting the header pipes via a connecting pipe. On the tops and bottoms of the primary heat exchanger and of the auxiliary heat exchanger, a pair of reinforcing side plates are mounted, and by engaging the opposing reinforcement plates to assemble the primary heat exchanger to the auxiliary heat exchanger, the heat exchanger's sturdiness is further reinforced, thereby preventing the header tanks from deforming the tubes.

15 Claims, 7 Drawing Sheets

HEAT EXCHANGER APPARATUS HAVING FLUID COUPLED PRIMARY HEAT EXCHANGER UNIT AND AUXILIARY HEAT EXCHANGER UNIT

BACKGROUND OF THE INVENTION

1. Field of the Invention

This invention pertains to a heat exchanger used for an automobile air conditioner.

2. Description of the Related Art

Conventional parallel flow type heat exchangers include a multi-layer structure of alternately stacked tube and fin members and header pipes connected to opposite ends of the tube members. The front surface of these heat exchangers generally defines a rectangular configuration. (See, for example, Japanese Kokai Patent No. 63-34466.)

However, to improve aerodynamic characteristics, there is a trend toward streamlining automobile hoods, and less top to bottom space is provided in front of the engine chamber. Therefore, there is often insufficient space provided in the vicinity of the lower portions of the heat exchanger which is positioned in front of the engine chamber, since head lights and pipe members also occupy and require space. If the size of the heat exchanger is reduced accordingly to facilitate positioning, a problem arises in that the heat exchanging capacity lowers as the front surface dimensions of the heat exchanger are reduced.

To cope with this problem, heat exchangers have been formed into shapes other than rectangles to enable the heat exchanger to be positioned without lowering heat exchanging capacity. Such heat exchangers are disclosed in Japanese Kokai Patent Publication Utility Model H1-161106 and Japanese Kokai Patent Publication H2-37287.

In the former publication (Kokai Patent Publication Utility Model H1-161106), a heat exchanger is formed in a desired configuration by dividing each header pipe into multiple pipe members and combining the members with tubes of different sizes.

In the latter publication (Kokai Patent Publication H2-37287), a heat exchanger is formed in a desired configuration by eliminating the four corners. This is done by bending both ends of the header pipe and making the length of the tubes corresponding to the bent portion of the header pipes shorter than that of the other tubes.

However, in the former constitution, since the header pipe is divided into multiple pipe members, and the tubes are supported only by the fins between them, the heat exchanger has insufficient structural strength. Therefore, the heat exchanger is susceptible to being deformed when it is installed in an automobile, which has been a problem.

In the latter constitution, bending a header pipe is a difficult task and a heat exchanger having a desired configuration cannot always be attained. Furthermore, the use of bent header pipes requires the provision of tubes of a variety of lengths, which is a problem in terms of cost, and therefore, is not practical.

Japanese Kokai Patent Publication Utility Model No. 63-74989 discloses a heat exchanger having a different front surface shape, in which one end of each of the multiple tubes in a stack is aligned and connected to one of the header tanks, and the other end of each of the tubes grouped according to size is connected to each of the multiple header tanks, which are divided along their length. Japanese Kokai Patent Publication Utility Model No. H2-127957 also discloses a heat exchanger, in which the front surface is formed in a different shape by the same method, and in which blind caps installed on the ends of each of the divided multiple header tanks are integrally connected with one another to reinforce the divided header tanks.

With these heat exchangers, a problem arises since the tubes are supported by jigs facing in toward the tube stack when the heat exchangers are soldered in an ordinary process, the ends of the divided header tanks connected to the ends of the shorter tubes are pressed against the middle point along the length of the longer tubes, resulting in deformation of the longer tubes.

SUMMARY OF THE INVENTION

A primary goal of this invention is to reinforce a heat exchanger.

A secondary goal of this invention is to offer a heat exchanger having a desired shape suited for an engine chamber of limited space, while simultaneously preventing the deformation of the tubes by reinforcing the heat exchanger.

In one preferred embodiment of the present invention, the heat exchanger is equipped with a primary heat exchanger formed of a multi-layer structure of alternately stacked tubes and fins and header pipes connected to opposite ends of each tube, and one or more similarly structured auxiliary heat exchangers. A distance between the header pipes of the auxiliary heat exchanger is shorter than that of the primary heat exchanger. Brackets are installed on the header pipes of the primary heat exchanger and on the header pipes of the auxiliary heat exchanger, to connect the primary heat exchanger and the auxiliary heat exchanger. A connecting pipe is used to fluid connect the header pipes of the primary heat exchanger and the header pipes of the auxiliary heat exchanger.

Therefore, according to the present invention, because the primary and the auxiliary heat exchangers are connected via the brackets installed on the header pipes, a solid connection between the primary and the auxiliary heat exchangers is ensured, and the configuration and size of the heat exchanger can be changed by optionally selecting the length of the tubes constituting each of the primary and auxiliary heat exchangers.

Many other structural advantages and features of the present invention can be easily conceived referring to the appended figures that illustrate the preferred embodiments of the present invention.

FIG. shows a cross sectional view of another engaging structure employing a side plate.

Figure 12:
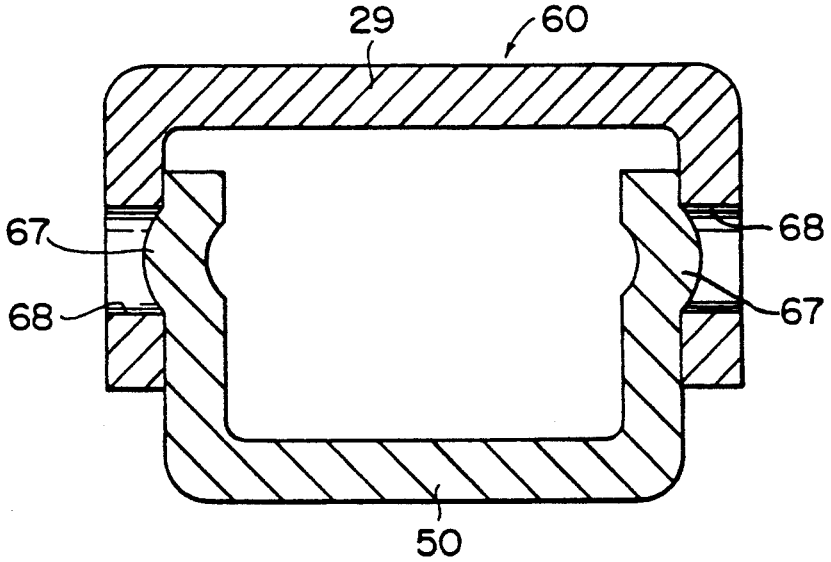

FIG. 12 shows a cross sectional view of another engaging structure employing a side plate.

Figure 13:
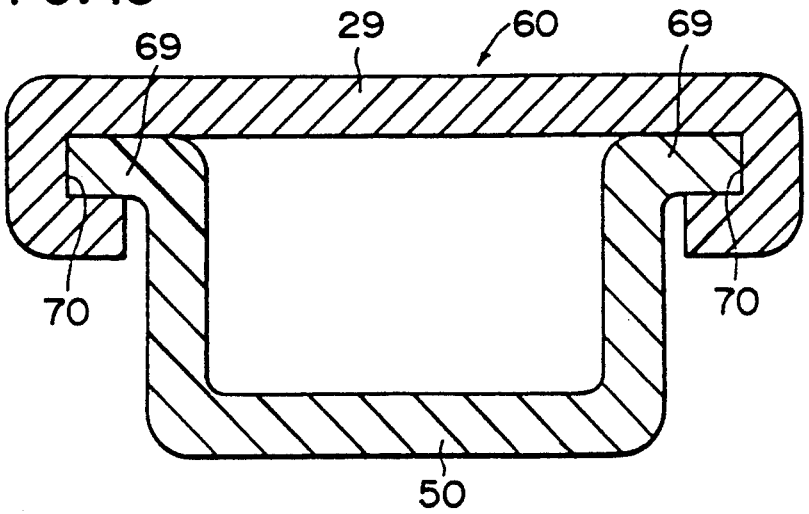
Figure 14:
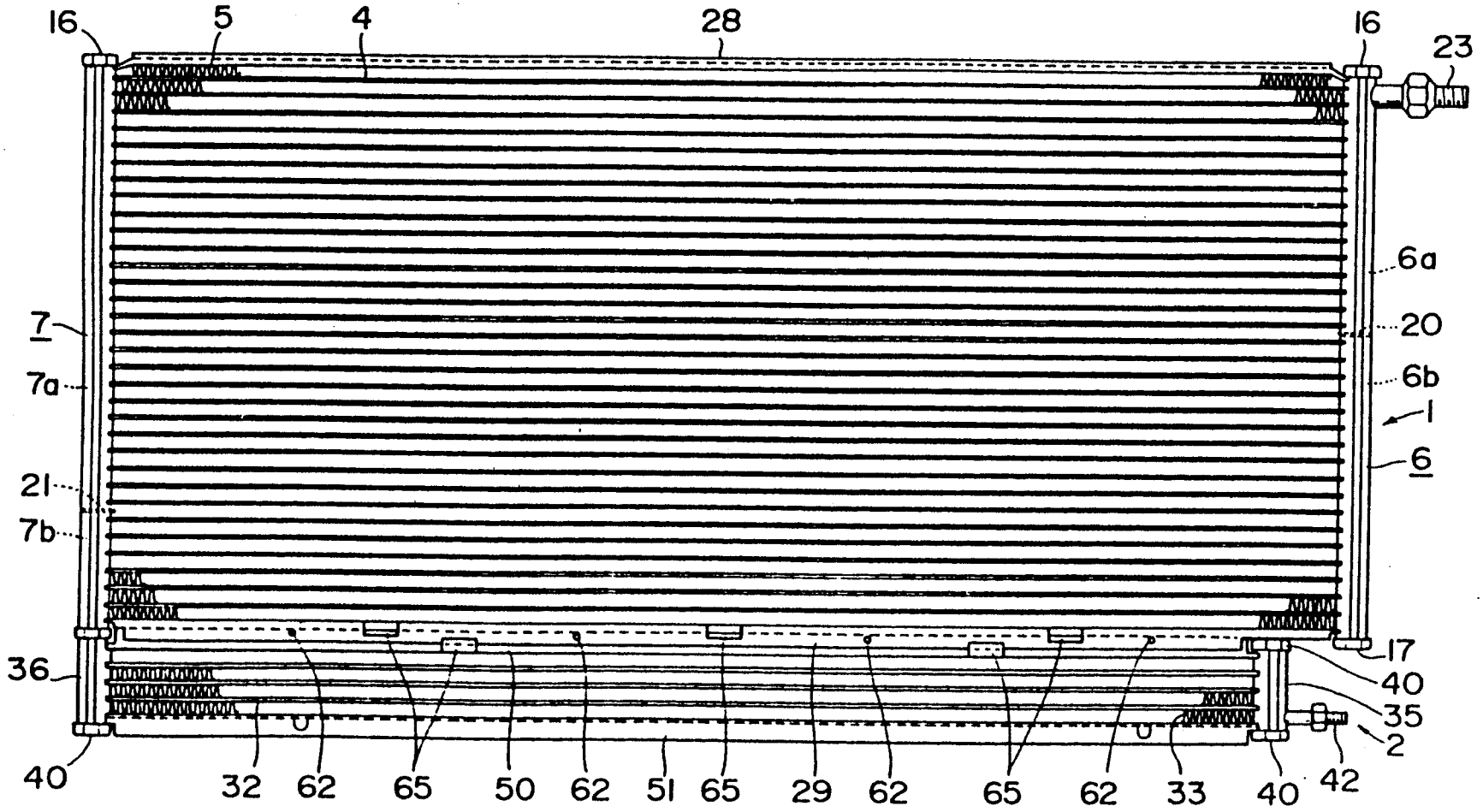

FIG. 13 shows a cross sectional view of another engaging structure employing a side plate FIG. 14 shows, as one example, a front view of a heat exchanger in which one header pipe of a primary heat exchanger and one header pipe of an auxiliary heat exchanger are directly connected.

DETAILED DESCRIPTION

The first embodiment of the present invention is explained below with reference to the figures.

FIG. 1 through FIG. 7 shows a parallel flow type heat exchanger apparatus that basically is structured by assembling a primary heat exchanger 1 and an auxiliary heat exchanger 1, each having header pipes of different lengths.

The primary heat exchanger 1 includes a multi-layer structure of alternately stacked first tubes 4 and first fins 5, and first and second header pipes 6, 7 connected to opposite ends of the first tubes 4 of the multi-layer structure.

Figure 3:
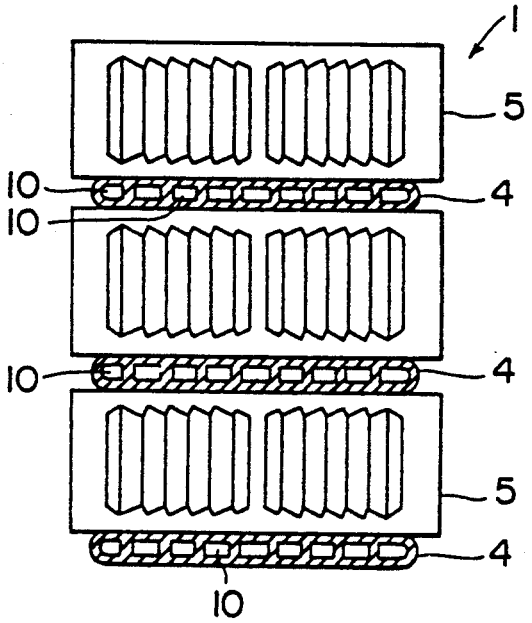
FIG. 3 shows a cross sectional view of line 100—100 in FIG. 1.
Figure 4:
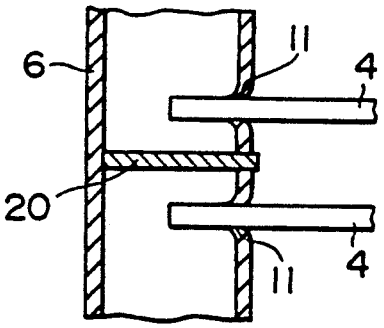
FIG. 4 shows a cross sectional view of line 200—200 in FIG. 2.

As shown in FIG. 3, the first tubes 4 are formed by injection molding and have multiple channels 10 formed therein. As shown in FIG. 4, the ends of the first tubes 4 are inserted into tube insertion holes 11 of the header pipes 6.

Figure 1:
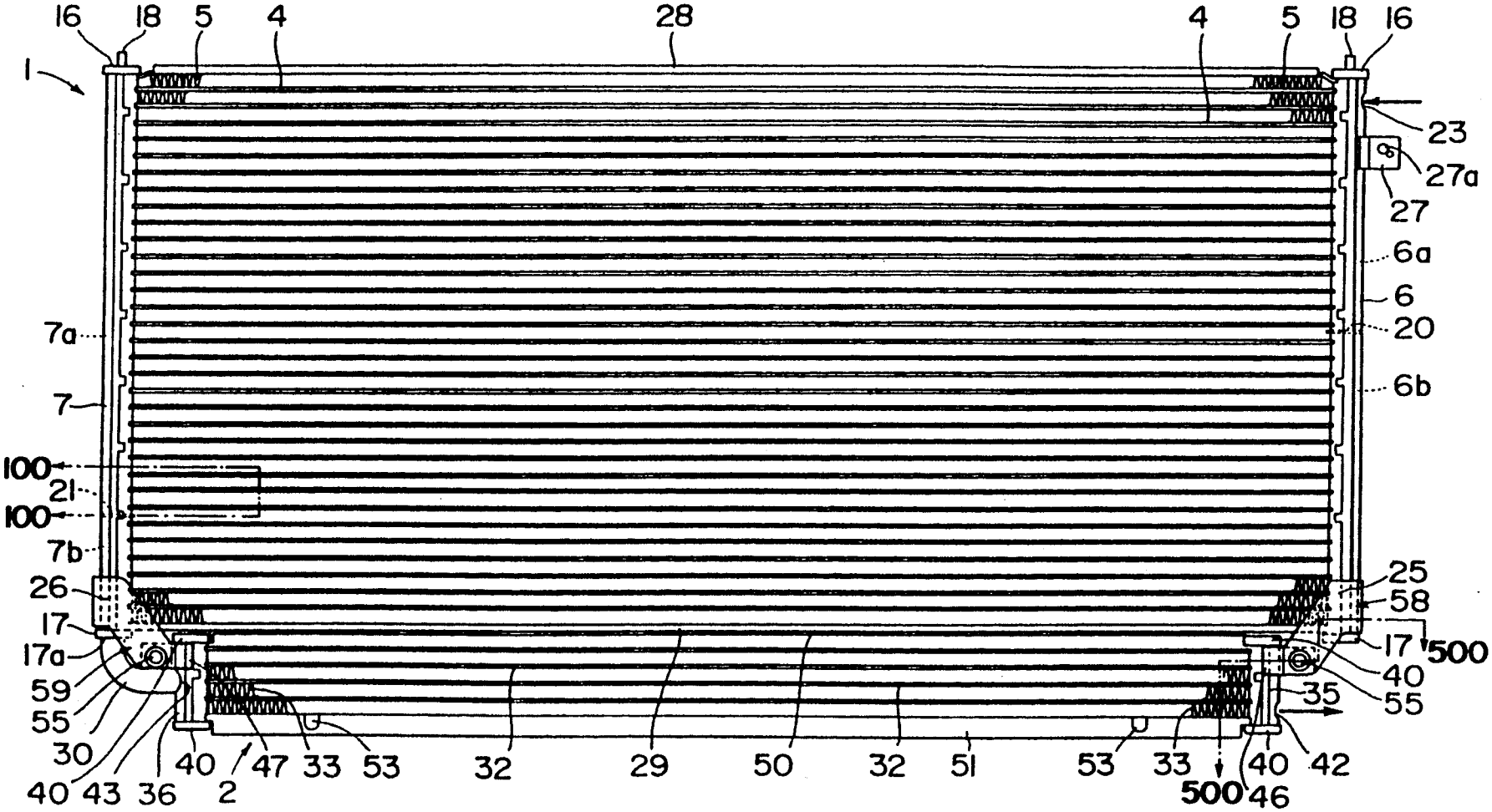
FIG. 1 shows a front view of a heat exchanger in a first embodiment of the present invention.
Figure 2:
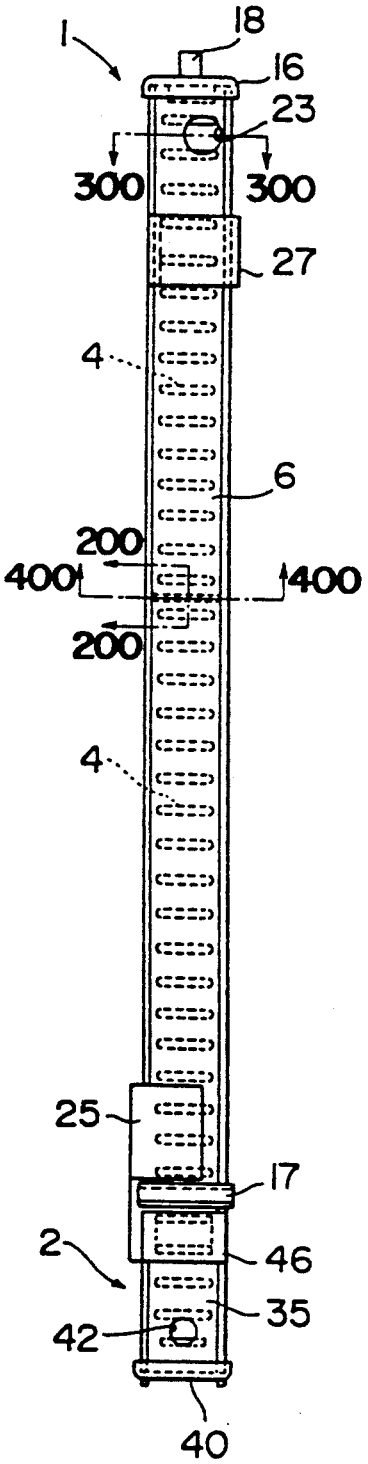
FIG. 2 shows a side view of the heat exchanger shown in FIG. 1.
Figure 5:
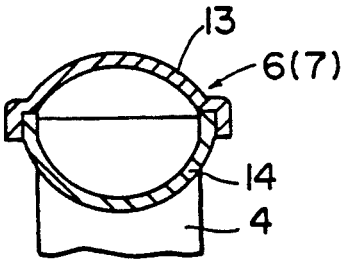
FIG. 5 shows a cross sectional view of line 300—300 in FIG. 2
Figure 6:
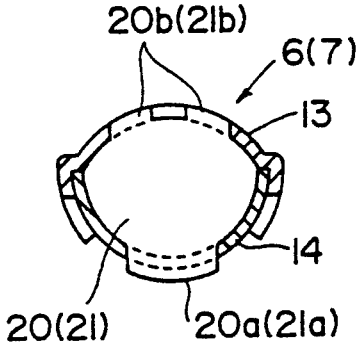
FIG. 6 shows a cross sectional view of line 400—400 in FIG. 2.

As shown in FIG. 1 and FIG. 5, the first and second header pipes 6, 7 are nearly cylindrical in shape and are made by joining nearly semi-cylindrical header pipe components 13, 14. The openings at both ends of these header pipes 6, 7 are sealed using caps 16, 17. On the cap 16, which is positioned at the upper side of the header pipes, a bushing 18 is installed to fix the heat exchanger to an automobile. As indicated in FIG. 1 and FIG. 6, dividers 20, 21 divide the inside of the header pipes 6, 7 into separate fluid compartments *6a, 6b, 7a, 7b*. The dividers 20, 21 are inserted in the first and second header pipes 6, 7 at prescribed positions through projections *20a, 21a, 20b, 21b*. A fluid intake 23 is provided at the upper side of header pipe 6.

Figure 7:
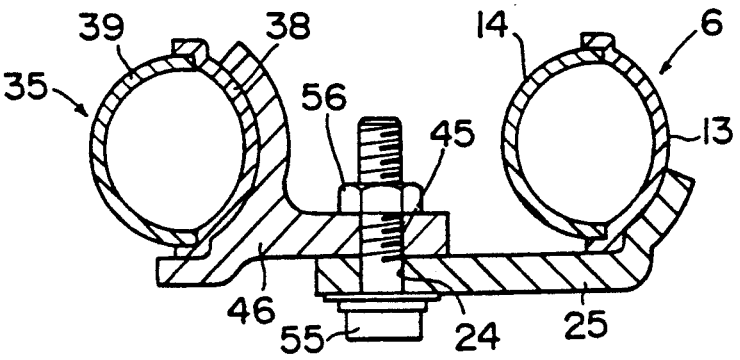
FIG. 7 shows a cross sectional view of line 500—500 in FIG. 1.

As indicated in FIG. 1 and FIG. 7, bracket components 25, 26 are fixed, by brazing or soldering, at prescribed positions on the lower side of first and second header pipes 6, 7. The bracket components 25, 26 form a part of near L-shaped first and second bracket 58, 59, have a screw through hole 24 formed therein, and are used to connect auxiliary heat exchanger 2 to the primary heat exchanger 1 as described below.

A bracket 27 is installed at the upper side of second header pipe 6 and includes a screw through hole *27a* to secure the heat exchanger to an automobile.

Furthermore, reinforcement plates 28, 29 are fixed to the top and bottom of the primary heat exchanger 1 to provide structural support.

The cap 17, located at the lower side of first header pipe 7, includes a pipe connecting hole *17a*, to which is fixed, by torch brazing or soldering, a connecting pipe 30 for providing fluid communication between the first header pipe 7 of the primary heat exchanger 1 and third header pipe 36 of the auxiliary heat exchanger 2. Connecting pipe 30 is fixed after primary heat exchanger 1 has been brazed or soldered.

In the auxiliary heat exchanger 2, the distance between the header pipes is less than that of the primary heat exchanger 1, and the number of stacked tubes is less than that of the primary heat exchanger Thus, the auxiliary heat exchanger 2 is smaller than the primary heat exchanger 1. The auxiliary heat exchanger 2 is constituted by a multi-layer structure of alternately stacked second tubes 32, which are shorter in length than the aforementioned first tubes 4, and second fins 33. The ends of the second tubes 32 are respectively connected to third and fourth header pipes 35, 36.

The third and fourth header pipes 35, 36 are shorter in length than the first and second header pipes 6, 7, have a nearly cylindrical configuration, and are formed by joining header pipe components 38, 39. Their openings at both ends are sealed by a cap 40. The header pipes 35, 36 do not contain dividers therein. A fluid outlet 42 is formed in the fourth header pipe 35, and a pipe connecting hole 43 is formed in the third header pipe 36 for receiving the connecting pipe 30. Bracket components 46, 47 are fixed, by brazing or soldering, to upper sides of the third and fourth header pipes 35, 36 at the prescribed positions. The bracket components 46, 47 form a part of the near L-shaped first and second brackets 58, 59, have a screw through hole 45 formed therein, and are used to connect the auxiliary heat exchanger 2 to the primary heat exchanger 1 (Refer to FIG. 7).

Reinforcement plates 50, 51 are fixed to the top and bottom of the auxiliary heat exchanger 2 to provide structural support. The side plate 51 is bent in a near L-shaped configuration, and includes mounting holes 53, 53 at prescribed positions to fix the heat exchanger to an automobile.

Primary heat exchanger 1 and auxiliary heat exchanger 2 are separately brazed or soldered and assembled. To form the heat exchanger apparatus by connecting the primary heat exchanger 1 with the auxiliary heat exchanger 2, the following assembly processes are utilized.

To connect the primary heat exchanger 1 and auxiliary heat exchanger 2, the bracket components 25, 26 and the bracket components 46, 47 are secured to the first and second header pipes 6, 7 of primary heat exchanger 1 and third and fourth header pipes 35, 36 of auxiliary heat exchanger 2, respectively. The brackets 58, 59 are then tightened using a bolt 55 and a nut 56 (Refer to FIG. 1 and FIG. 7). By so doing, primary heat exchanger 1 and auxiliary heat exchanger 2 may be connected without deformation. The connection between the primary heat exchanger 1 and auxiliary heat exchanger 2 is reinforced by bracket components 25, 26 and bracket components 46, 47. For connection between the brackets, rivets, spot welding or any other appropriate method may be used.

After the primary heat exchanger 1 and auxiliary heat exchanger 2 are connected via the first and second brackets 58, 59, the first header pipe 7 of the primary heat exchanger 1 and the third header pipe 36 of the auxiliary heat exchanger 2 are fluid connected via connecting pipe 30. One end of the connecting pipe 30 is connected, by torch brazing or soldering, to the pipe-connecting hole *17a* formed in the cap 17 of the primary heat exchanger 1, and the other end is similarly connected to the pipe-connecting hole 43 formed in the third header pipe 36 of the auxiliary heat exchanger 2.

The heat exchanger apparatus thus assembled is installed inside the engine chamber of an automobile via a bushing 18 and bracket 27 of the primary heat exchanger 1 and fastening holes 53, 53 of the auxiliary heat exchanger 2.

Fluid flows from the intake 23 into the fluid compartment 6a within the second header pipe 6 of the primary heat exchanger 1, runs through each tube 4 above divider 20 to fluid compartment *7a* within the first header pipe 7, and continues to flow through each tube 4 between divider 20 and 21 and returns to the fluid compartment *6b* within the second header pipe 6. The fluid then flows from the fluid compartment *6b* through each tube under divider 21 to fluid compartment *7b* within first header pipe 7, into the third header pipe 36 of the auxiliary heat exchanger 2 through connecting pipe 30, and after running through each tube 32 of the auxiliary heat exchanger 2, the fluid reaches the fourth header pipe 35 and is drained from outlet 42. Thus, the fluid flows in a so-called 4-pass flow pattern, and exchanges heat with that of the outside air while flowing through the tubes.

In the aforementioned heat exchanger apparatus, the primary heat exchanger 1 and auxiliary heat exchanger 2, each having a different distance between the header pipes thereof, are separately assembled and then connected via bracket components 24, 26 and 46, 47. Therefore, the heat exchanger apparatus can be made in a suitable configuration, and deformation can be prevented when the heat exchanger is installed and after it has been installed in an automobile having limited space.

By optionally changing the shape of the brackets connecting the primary heat exchanger 1 and the auxiliary heat exchanger 2, the auxiliary heat exchanger 2 can be set at any angle relative to primary heat exchanger 1, thereby allowing the heat exchanger apparatus to be made into a wide variety of configurations.

Furthermore, since the primary heat exchanger 1 and auxiliary heat exchanger 2 are built separately, the apparatus is well suited for automatic production and the brazing or soldering efficiency can be improved.

A second embodiment of the present invention will now be explained with reference to FIG. 8. It is noted that an explanation is not repeated regarding components which are identical to those in the aforementioned first embodiment. Rather, only the distinct components are explained.

Figure 8:
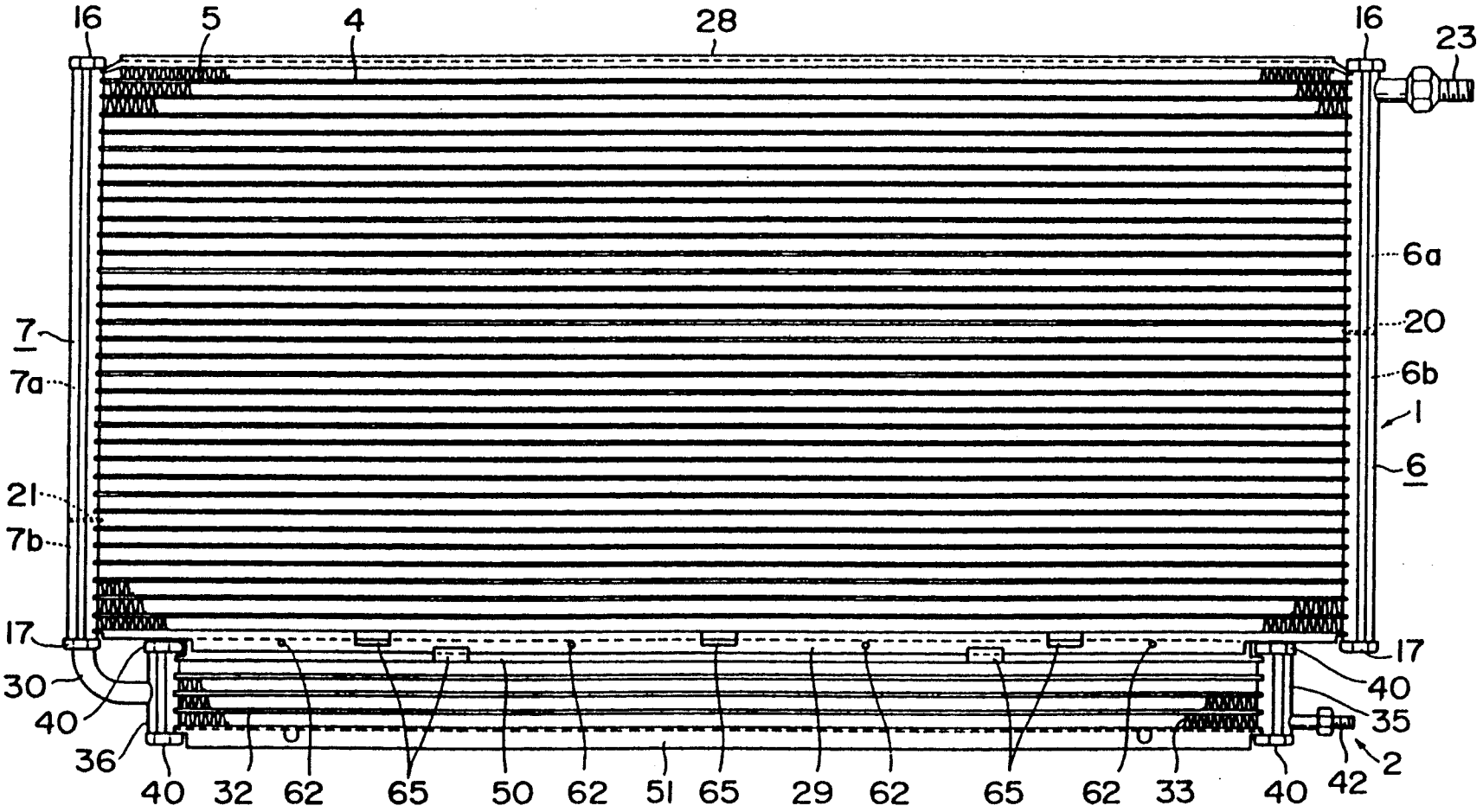
FIG. 8 shows a front view of a heat exchanger in a second embodiment of the present invention.
Figure 9:
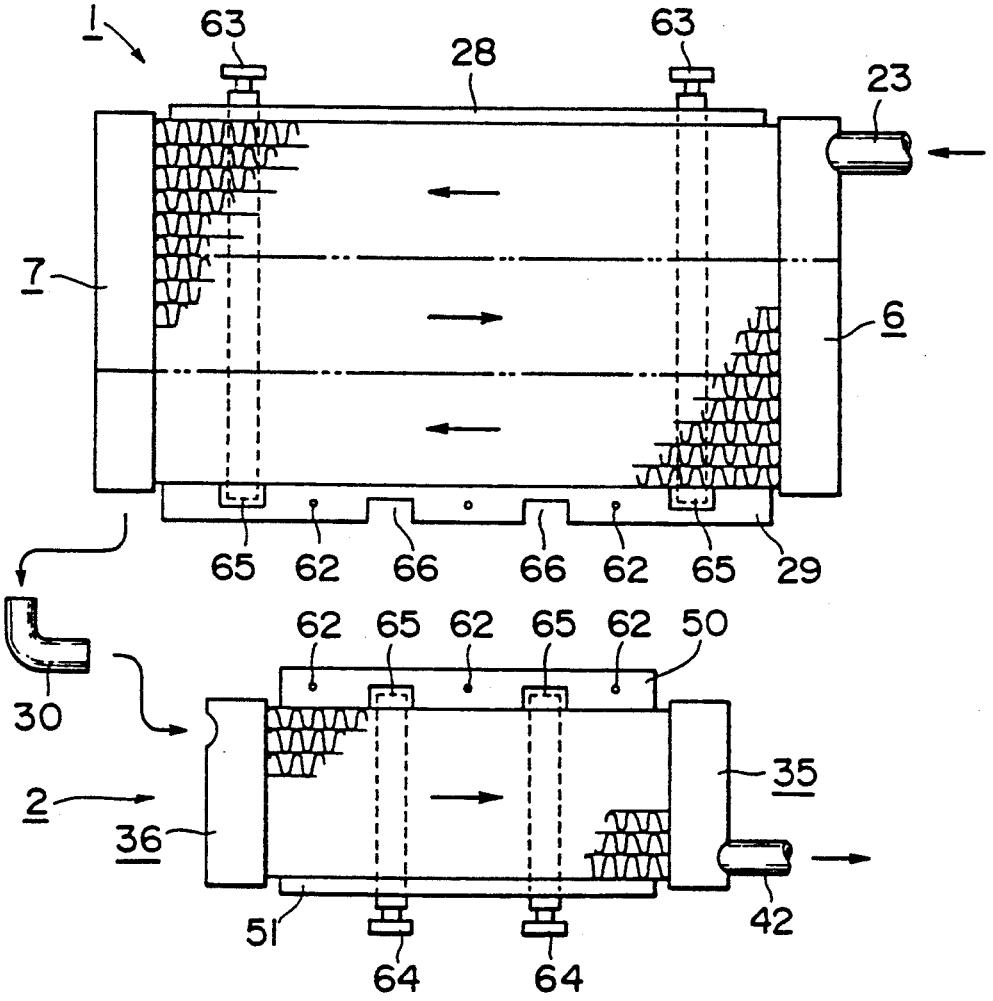
FIG. 9 is a schematic diagram illustrating a method of soldering a primary heat exchanger and an auxiliary heat exchanger.
Figure 10:
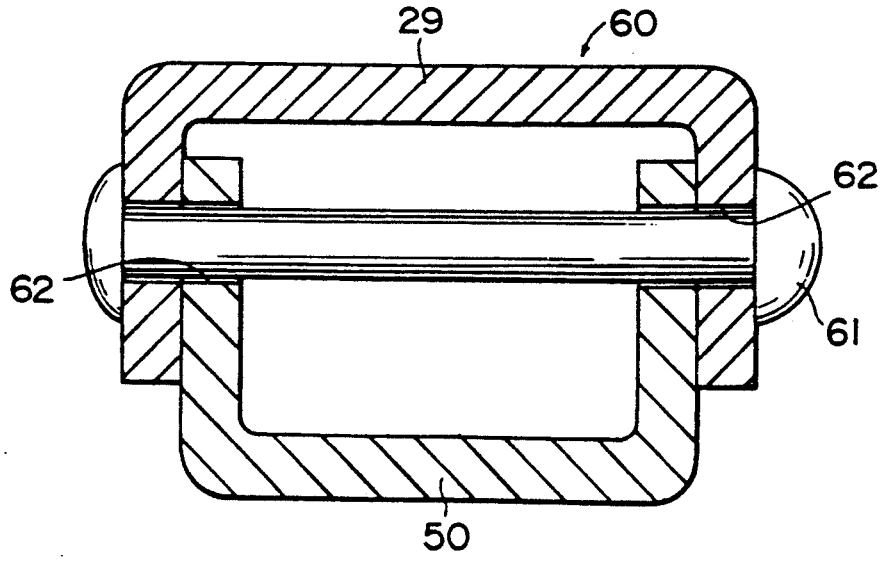
FIG. 10 shows a cross sectional view of an engaging structure employing a side plate.
Figure 11:
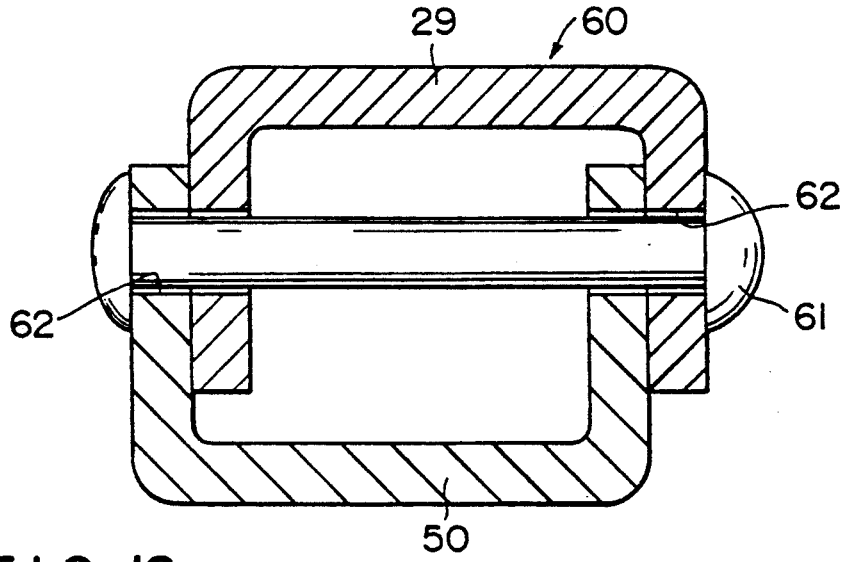

As indicated in FIG. 8 and FIG. 9, on the top and bottom of the primary heat exchanger 1 and the auxiliary heat exchanger 2, reinforcement plates 28, 29 and 50, 51 are mounted to provide structural support. The reinforcement plate 29 located at the lower side of the primary heat exchanger 1 and the reinforcement plate 50 located at the upper side of the auxiliary heat exchanger 2 constitute an engaging structure 50 as shown in FIG. 10 and FIG. 11. The engaging structure 60 is made by inserting the reinforcement plate 50, which has a bottom wall portion and opposite side wall portions defining a ]-shaped cross section and which is located at the upper side of the auxiliary heat exchanger 2, into the groove of the reinforcement plate 29 which also has a bottom wall portion and opposite side wall portions defining a ]-shaped cross-section and which is located at the lower side of the primary heat exchanger 1 (See FIG. 10). Alternately, the lower reinforcement plate 29 and the upper reinforcement plate 50 may have their positions displaced relative to each other (See FIG. 11).

It is determined where the primary heat exchanger and auxiliary heat exchanger 2 are to be positioned from the top to the bottom and from the front to the back, and then they are connected and integrally brazed or soldered.

As indicated in FIG. 10 and FIG. 11, their relative right to left positions are fixed by shooting rivets 61 in multiple riveting holes 62 which are formed the opposite side wall portions of both reinforcement plates 29 and 50 on the lower side of primary heat exchanger 1 and the upper side of auxiliary heat exchanger 2, as shown in FIG. 9 through FIG. 11.

Moreover, as shown in FIG. 8 and in FIG. 9, jig slits 65 are formed in the reinforcement plates 29, 50 at the lower side of the primary heat exchanger 1 and the upper side of the auxiliary heat exchanger 2. The jig slits 65 are for receiving jig claws 63, 64 when the primary heat exchanger 1 and auxiliary heat exchanger 2 are assembled to each other. Indentations 66 are made in the lower reinforcement plate 29 of primary heat exchanger 1, corresponding to jig slits 65 made in reinforcement plate 50 at the upper side of auxiliary heat exchanger 2. Therefore, after the primary heat exchanger 1 and auxiliary heat exchanger 2 have been brazed or soldered and assembled while being held by the jig claws 63, 64, respectively, the jig claws 64 used for constituting the auxiliary heat exchanger 2 can be pulled from the jig slits 65 without being blocked by the engaging structure made by both reinforcement plates 29, 50 at the opposite position. Accordingly, the assembly accuracy of the primary heat exchanger 1 and auxiliary heat exchanger 2 can be enhanced. Furthermore, a material of the reinforcement plates 29, 50, which are used to braze or solder connect the primary heat exchanger 1 and auxiliary heat exchanger 2, is clad on both or one side.

To obtain the desired heat exchanger apparatus by assembling the primary heat exchanger and auxiliary heat exchanger 2, the primary heat exchanger 1 and auxiliary heat exchanger 2 must first be integrated separately using each jig claw 63, 64. By so doing, deformation of the first tubes 4 by the third and fourth header pipes 35, 36 can be avoided, and in contrast to the conventional techniques, a special device for heat exchangers having variable front shapes becomes unnecessary. Since the primary heat exchanger 1 and auxiliary heat exchanger 2 have reinforcement plates 28, 292, 50, 51 mounted on the tops and bottom thereof, the sturdiness of the entire heat exchanger apparatus is enhanced. When the separately built primary heat exchanger 1 and auxiliary heat exchanger 2 are connected and assembled, the engaging structure 60 constituted of two opposing reinforcement plates 29, 50 facilitates positioning and the riveting makes the joint more secure. Further, the differently sized primary heat exchanger 1 and auxiliary heat exchanger 2 are brazed or soldered after they are coupled with the connecting pipe 30, thereby allowing relatively easy production of heat exchangers having variable front shapes according to the installation space in an automobile.

Moreover, it goes without saying that many variations and revisions can be made to the present invention within the aforementioned technical content. For example, as shown by FIG. 12, it is possible to constitute an engaging structure in which a convex engaging unit 67 is formed on the outer sides of both groove walls of the lower side plate 50 having a ]-shaped cross section, and in which this convex engaging structure 67 is engaged in a concave portion 68 formed in the inner groove walls of the upper side plate 60 when it is inserted in the upper side plate 60 having the ]-shaped cross section.

Also, as indicated in FIG. 13, it is possible to constitute an engaging structure in which engaging members 69 are formed so as to bend outward from the ends of the groove walls of the upper side plate 50, and in which this engaging member 69 is engaged in engaging concave portions 70 formed on the ends of the groove walls of the upper side plate 50 so as to bend toward the groove when it is inserted in the groove of the upper side plate 29 having the ]-shaped cross section.

Furthermore, as indicated in FIG. 14, the primary heat exchanger 1 and auxiliary heat exchanger 2 may be assembled by directly connecting header pipes 7 and 36 without using a connecting pipe 30. It is conceivable to embody the present invention by ways other than that specified in the additional claims. Therefore, any variant form of an embodiment deriving from the principles of the present invention is deemed to be included in the claims of the present invention.

What is claimed is:

1. A heat exchanger apparatus comprising:

a primary heat exchanger having a first multi-layer structure of alternately stacked first tube and fin members, and first and second header pipes respectively coupled to opposite ends of said first tube members along opposite edges of said first multi-layer structure;

an auxiliary heat exchanger having a second multi-layer structure of alternately stacked second tube and fin members and third and fourth header pipes respectively coupled to opposite ends of said second tube members along opposite side edges of said second multi-layer structure, wherein the distance between said first and second header pipes of said primary heat exchanger is greater than the distance between said third and fourth header pipes of said auxiliary heat exchanger;

a first bracket member extending between said first and third header pipes, and a second bracket member extending between said second and fourth header pipes, said first and second bracket members securing said auxiliary heat exchanger to said primary heat exchanger; and, a tubular member extending between said primary heat exchanger and said auxiliary heat exchanger for providing fluid communication therebetween.

2. A heat exchanger apparatus as recited in claim 1, wherein a bottom edge of said first multi-layer structure is located along a top edge of said second multi-layer structure.

3. A heat exchanger apparatus as recited in claim 1, wherein said first and second bracket members are brazed or soldered to said first and third header pipes and said second and fourth header pipes, respectively.

4. A heat exchanger apparatus as recited in claim 1, wherein each of said first and second bracket member is pivotable about a tightening member, and wherein a configuration of each of said first and second bracket members is fixed by said tightening member.

5. A heat exchanger apparatus as recited in claim 1, wherein said tubular member extends between an end portion of said first header pipe and a side portion of said third header pipe.

6. A heat exchanger apparatus as recited in claim 1, wherein said primary heat exchanger includes reinforcement plates mounted to and along opposite top and bottom edges of said first multi-layer structure, and wherein said auxiliary heat exchanger includes reinforcement plates mounted to and along opposite top and bottom edges of said second multi-layer structure.

7. A heat exchanger apparatus as recited in claim 1, further comprising divider members contained within said first and second header pipes for providing separate fluid compartments within each of said first and second header pipes, and wherein a fluid path of said heat exchanger apparatus extends from an intake to one of said fluid compartments of one of said first and second header pipes, at least back and forth through a set of said first tube members to another one of said fluid compartments of one of said first and second header pipes, and to said auxiliary heat exchanger via said tubular member.

8. A heat exchanger apparatus comprising:

a primary heat exchanger having a first multi-layer structure of alternately stacked first tube and fin members and first and second header pipes respectively coupled to opposite ends of said first tube members along opposite side edges of said first multi-layer structure;

an auxiliary heat exchanger having a second multi-layer structure of alternately stacked second tube and fin members and third and fourth header pipes respectively coupled to opposite ends of said second tube members along opposite side edges of said second multi-layer structure, wherein the distance between said first and second header pipes of said primary heat exchanger is greater than the distance between said third and fourth header pipes of said auxiliary heat exchanger; and, a first reinforcement plate mounted to and along a bottom edge of said first multi-layer structure and a second reinforcement plate mounted to and along a top edge of said second multi-layer structure, said first and second reinforcement plates fixed to each other to secure said auxiliary heat exchanger to said primary heat exchanger.

9. A heat exchanger apparatus as recited in claim 8, further comprising a tubular member extending between said first and third header pipes for providing fluid communication between said primary heat exchanger and said auxiliary heat exchanger.

10. A heat exchanger apparatus as recited in claim 8, wherein one end of said first pipe is directly coupled to one end of said third header pipe to provide fluid communication therebetween.

11. A heat exchanger apparatus as recited in claim 8, wherein each of said first and second reinforcement plates includes a bottom wall portion and opposite side wall portions defining a ]-shaped cross-section, and wherein the opening of said ]-shaped cross-section defined by said first reinforcement plate confronts the opening of said ]-shaped cross-section defined by said second reinforcement plate, and wherein said opposite side wall portions of said first reinforcement plate are riveted to said opposite side wall portions of said second reinforcement plate.

12. A heat exchanger apparatus recited in claim 8, wherein each of said first and second reinforcement plates includes a bottom wall portion and opposite side wall portions defining a ]-shaped cross-section, and wherein the opening of said ]-shaped cross-section defined by said first reinforcement plate confronts the opening of said ]-shaped cross-section defined by said second reinforcement plate, and wherein a convex configuration formed in said opposite side walls of one of said first and second reinforcement plates fixedly engages a concave configuration formed in said opposite side walls of the other of said first and second reinforcement plates.

13. A heat exchanger apparatus as recited in claim 8, wherein each of said first and second reinforcement plates includes a bottom wall portion and opposite side wall portions defining a ]-shaped cross-section, and wherein the opening of said ]-shaped cross-section defined by said first reinforcement plate confronts the opening of said ]-shaped cross-section defined by said second reinforcement plate, and wherein outwardly extending lip members formed by said opposite side walls of one of said first and second reinforcement plates fixedly engages a concave configuration formed by said opposite side walls of the other of said first and second reinforcement plates.

14. A heat exchanger apparatus as recited in claim 8, wherein said first reinforcement plate contains at least one first aperture therein, and wherein said second reinforcement plate contains at least one second aperture therein, and wherein said first and second apertures are aligned with each other to permit the extension of a jig claw member therethrough.

15. A heat exchanger apparatus as recited in claim 8, further comprising divider members contained within said first and second header pipes for providing separate fluid compartments within each of said first and second header pipes, and wherein a fluid path of said heat exchanger apparatus extends from an intake to one of said fluid compartments of one of said first and second header pipes, at least back and forth through a set of said first tube members to another one of said fluid compartments of one of said first and second header pipes, and to said auxiliary heat exchanger via said tubular member.

* * * * *